US006125668A

United States Patent [19]

Belden, Jr.

[11] Patent Number: 6,125,668

[45] Date of Patent: Oct. 3, 2000

[54] RECORDED MEDIA SECURITY CONTAINER

[75] Inventor: Dennis D. Belden, Jr., Canton, Ohio

[73] Assignee: Alpha Enterprises, Inc., North Canton, Ohio

[21] Appl. No.: 09/197,593

[22] Filed: Nov. 23, 1998

[51] Int. Cl.[7] ..... E05B 65/00

[52] U.S. Cl. ..... 70/57.1; 292/300; 70/63

[58] Field of Search ..... 70/57.1, 57, 58, 70/63; 206/387.11, 308.2; 292/300, 302, DIG. 11

[56] References Cited

U.S. PATENT DOCUMENTS

| | | | |
|---|---|---|---|
| 806,768 | 12/1905 | Bauer . | |
| 3,590,614 | 7/1971 | Kunst | 70/298 |
| 4,153,178 | 5/1979 | Weavers | 220/306 |
| 4,469,225 | 9/1984 | Takahashi | 206/387 |
| 4,966,020 | 10/1990 | Fotheringham et al. | 70/276 |
| 5,205,401 | 4/1993 | Weisburn et al. | 206/1.5 |
| 5,276,588 | 1/1994 | Repplinger et al. | 361/736 |
| 5,375,712 | 12/1994 | Weisburn | 206/387 |
| 5,680,782 | 10/1997 | Komatsu et al. | 70/54.1 |
| 5,760,689 | 6/1998 | Holmgren | 340/568 |
| 5,762,187 | 6/1998 | Belden, Jr. et al. | 206/308.2 |

*Primary Examiner*—Lynne H. Browne
*Assistant Examiner*—John B. Walsh
*Attorney, Agent, or Firm*—Sand & Sebolt

[57] ABSTRACT

A security storage container for storing items of recorded media or other small items in a secure manner while allowing the items to be seen includes a box, a lid, and a slide latch. The slide latch is disposed outside the lid and is directly grasped by the user to move it between the locked and unlocked positions. The lid, box, and slide latch are configured to prevent a pry bar from being used to open the security container. The lid and slide latch include a locking mechanism that may be unlocked by a specific key. The lid is locked with respect to the box when a plurality of tangs disposed on the slide latch are trapped under a plurality of ledges disposed on the box.

12 Claims, 8 Drawing Sheets

RECORDED MEDIA SECURITY CONTAINER

BACKGROUND OF THE INVENTION

TECHNICAL FIELD

The present invention relates to containers, and in particular, to a container for storing various articles including video game cassettes, video cassettes, other items of recorded media, or small items. Specifically, the invention relates to a storage container that can be securely locked in a closed position preventing the unauthorized removal of the contents of the storage container until a user unlocks the storage container with a manually-operated key.

BACKGROUND INFORMATION

Containers, and in particular, lightweight inexpensively molded plastic containers, are used for a variety of purposes and for the storage of various articles. One use of such plastic containers is for the storage of video and audio cassettes for both display and sale, as well as for home storage. Another use for such containers is to store video game cassettes that are often of a different shape and size than video and audio cassettes. One particular use of a plastic storage container that is formed of a transparent material is the display of the cassette at a retail store. It is, however, desirable that the container be lockable to prevent the unauthorized removal of the cassette therefrom thereby preventing its unauthorized removal from the store. The container also preferably holds an E.A.S. (electronic article surveillance) tag located inside the container that will sound an alarm should a thief attempt to remove the container and cassette from the store past a security checkpoint.

The present invention provides an inexpensive plastic storage container that may be used to store various articles such as video, audio, and game cassettes therein. The storage container may be selectively locked to prevent the unauthorized removal of the article within the storage container until the container is unlocked and opened by an authorized person.

Numerous storage containers for storing articles, including video, audio, and game cassettes, are known in the art with various types of locking mechanisms used to maintain the locked position. Although these storage containers function for their intended purposes, there remains room in the art for an improved design that does not include protuberances or openings that allow the potential shoplifter to pry at the lock. It is also desired that the storage container and locking member do not significantly increase the size of the item being stored in the box such that required shelf space is minimized. It is further desired that the lock mechanism be easy to operate and remains attached to the storage container when in the unlocked position.

SUMMARY OF THE INVENTION

In view of the foregoing, it is an objective of the invention to provide an improved storage container that is preferably formed of a transparent, lightweight molded plastic, that can be mass produced relatively inexpensively, and that is provided with a rigid locking member that selectively locks the lid of the storage container in a locked position until the locking member is moved to an unlocked position by the use of a specifically configured key by authorized personnel.

Another objective of the invention is to provide a storage container having at least a portion fabricated from a transparent material so that the contents of the container may be viewed by a customer.

A further objective of the invention is to provide a storage container that uses a simple rigid plastic slide to secure the lid of the storage container in a locked position to prevent unauthorized opening of the storage container, and which is unlocked and slid to an open position by the simple manual manipulation of an inexpensive plastic injection molded key.

Another objective of the invention is to provide a storage container that can be mass produced relatively inexpensively by plastic molding procedures, that provides both physical and theft prevention to an article stored within the container, and that provides a relatively dust free container for storing and displaying an article.

An additional objective of the invention is to provide a storage container in which an E.A.S. tag may be attached to an inside surface of the locked member to prevent theft.

A further objective of the invention is to provide a storage container in which an E.A.S. tag may be attached to an inside surface of the storage container itself to prevent theft.

Another objective of the invention is to provide a storage container that has a locking member on the lid of the storage container that does not create protuberances or openings suitable for attack by a pry bar.

Another objective of the invention is to provide a storage container that has a locking member attached to the lid of the storage container that does not significantly increase the overall size of the storage container.

Another objective of the invention is to provide a storage container having a locking mechanism that can be directly grasped by the user and moved from the unlocked position to the locked position.

Another objective of the present invention is to provide a storage container having a locking member that remains connected to the storage container when the container is unlocked.

A further objective of the invention is to provide a storage container having a lock member that is formed as a one piece molded product and a lid that is formed as a one piece molded product with the assembly of the lock member and the lid being a one step, quick and easy assembly procedure.

A further objective of the present invention is to provide a storage container that is of simple construction, that achieves the stated objectives in a simple, effective, and inexpensive manner, that solves the problems and that satisfies the needs existing in the art.

These and other objectives and advantages are obtained by the improved storage container of the present invention, the general nature of which may be stated as including a box having an open top; a lid hingedly connected to the box and movable between open and closed positions; a slide latch slidably carried by the lid and movable between locked and unlocked positions, the slide latch holding the lid closed when in the locked position; the slide carried on the outside of the lid; and a lock mechanism that locks the slide latch in the locked position.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numbers refer to similar parts throughout the specification.

DESCRIPTION OF THE PREFERRED EMBODIMENTS

Figure 1:
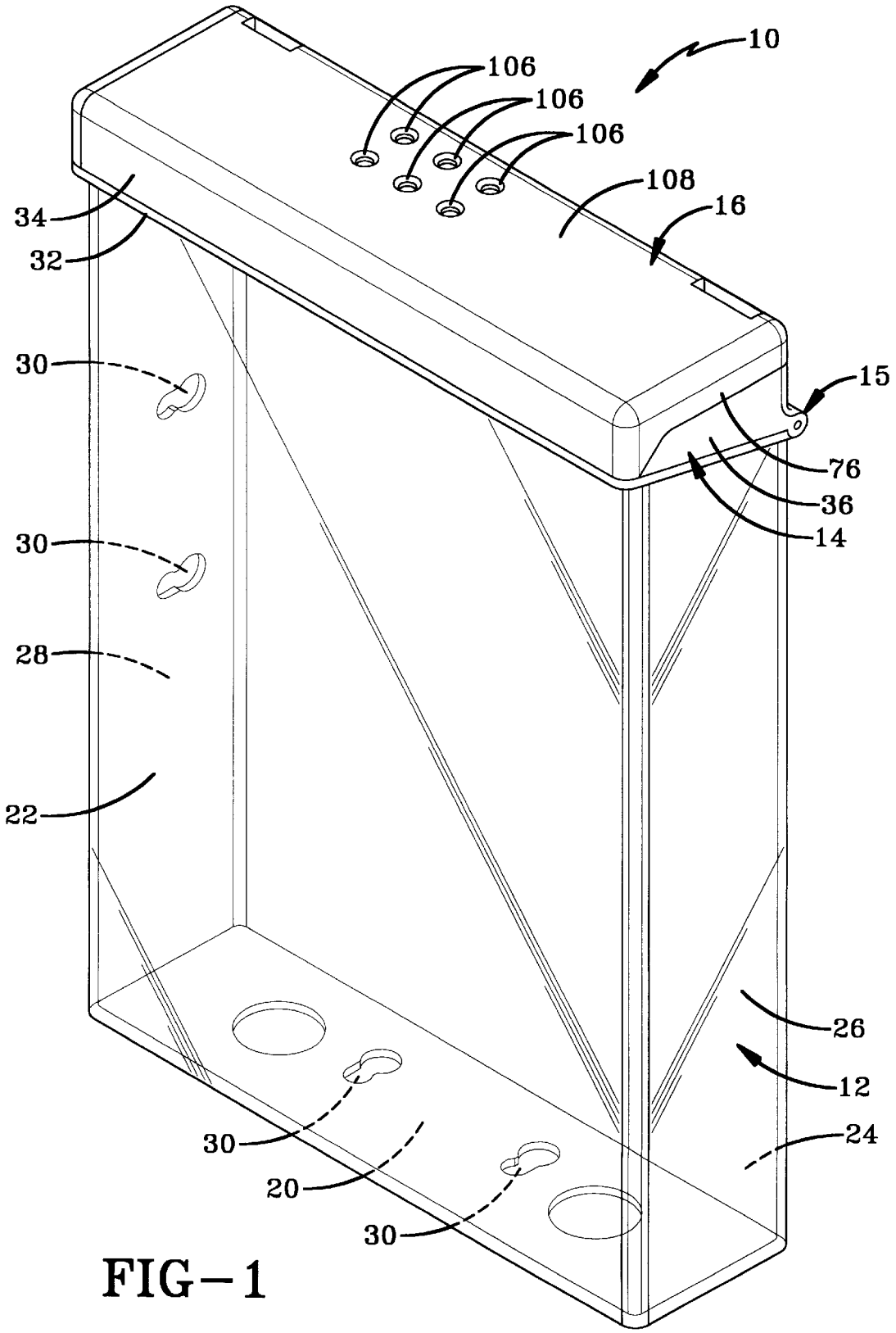
FIG. 1 is front perspective view of the storage container in a closed and locked position.

The security container of the present invention is depicted in the drawings and is indicated generally by the numeral 10. Security container 10 generally includes a box, indicated by the numeral 12, and a lid, indicated by the numeral 14, hingedly connected to box 12 by a pair of hinges 15 and movable between open and closed positions. Security container 10 also includes a slide latch, indicated by the numeral 16, that is slidably carried on lid 14 between locked and unlocked positions. These elements may each be fabricated from a transparent plastic that allows the contents of box 12 to be viewed by the consumer. Alternatively, lid 14 and slide latch 16 may be fabricated from an opaque material to prevent the locking arrangement of security container 10 from being viewed by a potential shoplifter.

Figure 14:
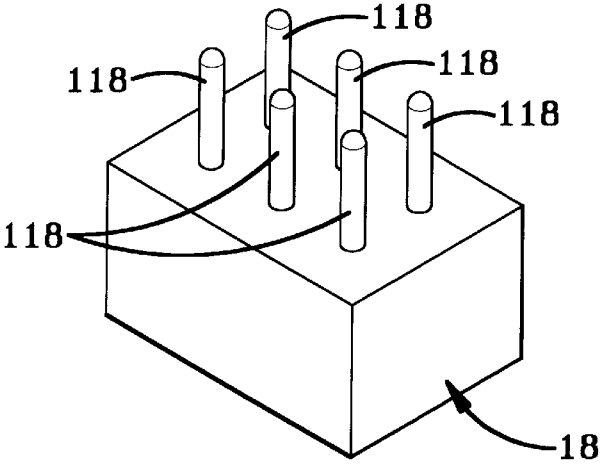
FIG-14 PRIOR ART
FIG. 14 is a perspective view of a key that is known in the art.

Security container 10 is used to display items of recorded media (not shown) or other small items in a secure manner in which they can be viewed by a consumer browsing in a store. Security container 10 may be quickly and easily opened from the locked position depicted in FIG. 1 by utilizing a key 18 (depicted in FIG. 14) to move slide latch 16 to the unlocked position so that lid 14 may be opened.

Box 12 includes a bottom wall 20, a front wall 22, a rear wall 24, a first sidewall 26, and a second sidewall 28 that cooperate to form a chamber for receiving items of recorded media or other small items. As seen in FIG. 1, box 12 may include mounting holes 30 that may be used to mount box 12 on a display rack or wall.

In accordance with one of the objectives of the present invention, a lip 32 projects outwardly from the top of front wall 22 and sidewalls 26 and 28. Lip 32 is sized and adapted to form a smooth connection with lid 14 at the sides of box 12 and a smooth connection between slide latch 16 at the front of box 12. Such smooth connections prevent a potential shoplifter from attacking security container 10 with a pry bar by eliminating edges or gaps into which a pry bar may be inserted. Specifically, slide latch 16 includes a front wall 34 that abuts lip 32 when lid 14 is in the closed position to form a smooth connection that is essentially seamless between slide latch 16 and box 12.

Lid 14 includes a first sidewall 36 and a second sidewall 38 that also meet with lip 32 to form a smooth connection between lid 14 and box 12. A tenon 40 projects upwardly from lip 32 above each sidewall 26 and 28 of box 12. A mortise 42 is formed in each sidewall 36 and 38 of lid 14 to snugly receive tenon 40 when lid 14 is in the closed position. Tenons 40 and mortises 42 not only ensure that lid 14 is properly aligned with box 12 and prevent a shoplifter from inserting a pry bar between lid 14 and lip 32 adjacent sidewalls 26 and 28, but also provides a strong connection between lid 14 and box 12.

Figure 2:
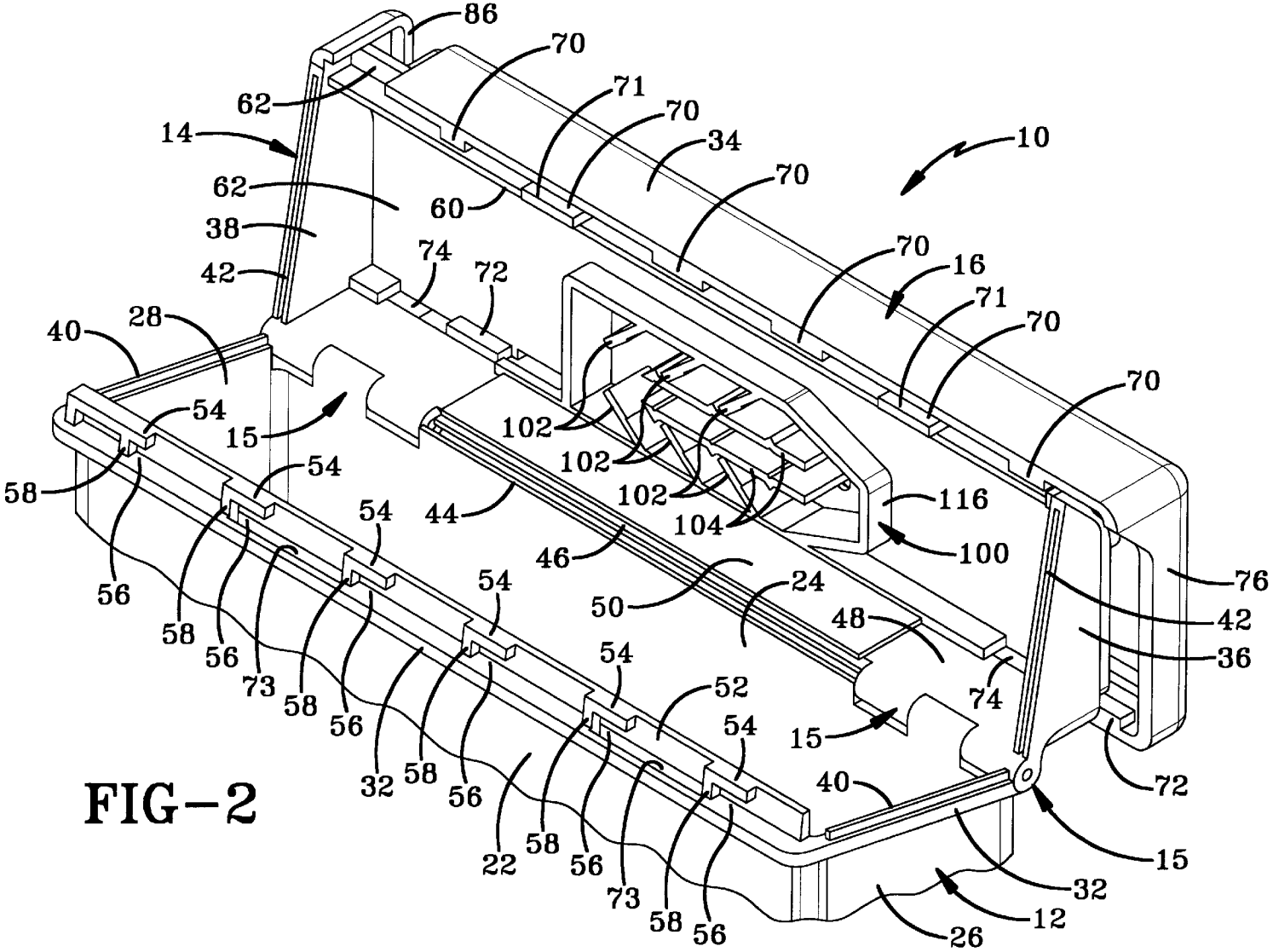
FIG. 2 is a front perspective view of the lid and slide latch of the storage container with the lid in the open position and the slide latch in the unlocked position.
Figure 3:
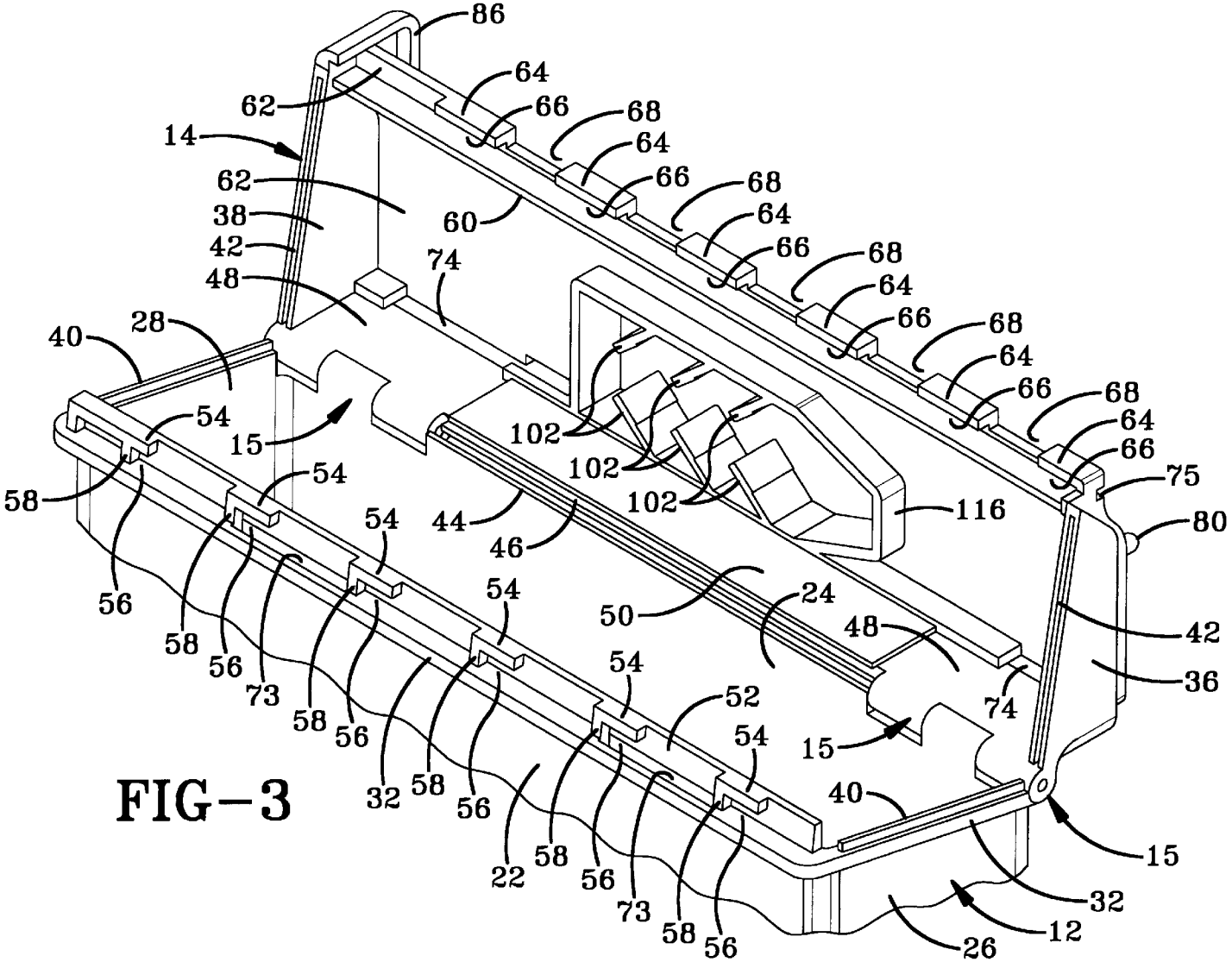
FIG. 3 is a view similar to FIG. 2 with the slide latch removed.
Figure 11:
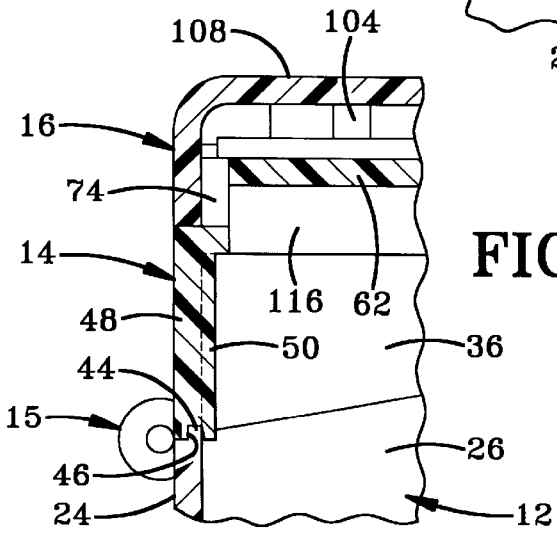
FIG. 11 is a sectional view taken along line 11—11 of FIG. 6.
Figure 12:
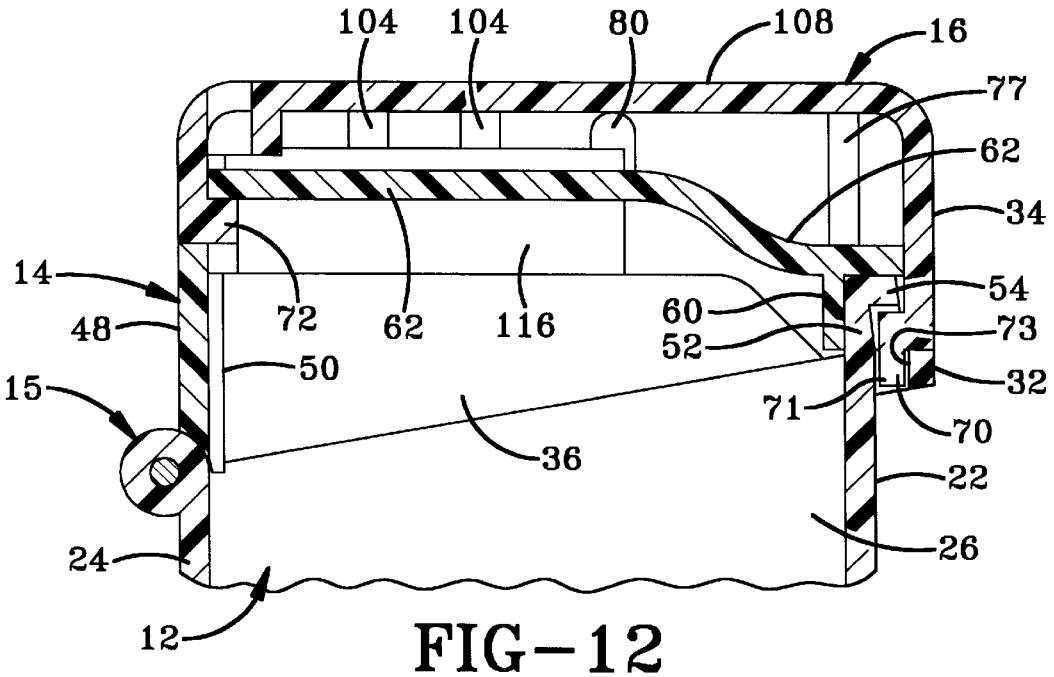
FIG. 12 is a sectional view taken along line 12—12 of FIG. 8.

As shown in FIGS. 2, 3, and 11, a shoulder 44 is formed at the upper edge of rear wall 24 of box 12 between hinges 15. A channel 46 is formed between the rear wall 48 of lid 14 and a reinforcement wall 50. The upper portion of shoulder 44 is received in channel 46 between rear wall 48 and reinforcement wall 50 when lid 14 is in the closed position. This configuration prevents a potential shoplifter from inserting a pry bar into box 12 between hinges 15.

The front of security container 10 is protected against the insertion of a pry bar by the provision of a stopping wall 52 that extends upwardly from lip 32 across front wall 22 of box 12. Stopping wall 52 may be integrally formed with front wall 22 as may be lip 32. Stopping wall 52 also provides a surface from which a plurality of first ledges 54 project. Each first ledge 54 is disposed above lip 32 such that a locking channel 56 is defined between each first ledge 54 and lip 32. An end wall 58 connects an end of each first ledge 54 to lip 32 to close locking channels 56.

The front wall 60 of lid 14 extends between sidewalls 36 and 38 of lid 14 and is set back from the forward edges of sidewalls 36 and 38 such that it slides behind stopping wall 52 when lid 14 is in the closed position as depicted in FIG. 11. The top wall 62 of lid 14 overhangs front wall 60 so as to at least partially abut the top of stopping wall 52 and first ledges 54. A second ledge 64 extends down from top wall 62 and forms a stopping wall receiving channel 66 between each second ledge 64 and the front surface of front wall 60. Each stopping wall receiving channel 66 is configured to snugly receive stopping wall 52 when lid 14 is in the closed position. Each second ledge 64 is aligned with and disposed between first ledges 54 when lid 14 is in the closed position. In this position, second ledges 64 cooperate with first ledges 54 to extend each locking channel 56 entirely between pairs of end walls 58.

Top wall 62 of lid 14 includes a cut out 68 between each second ledge 64. Cut out 68 allows an inwardly projecting tang 70 that projects inward from front wall 34 of slide latch 16 to pass between second ledges 64 when slide latch 16 and lid 14 are assembled.

Figure 7:
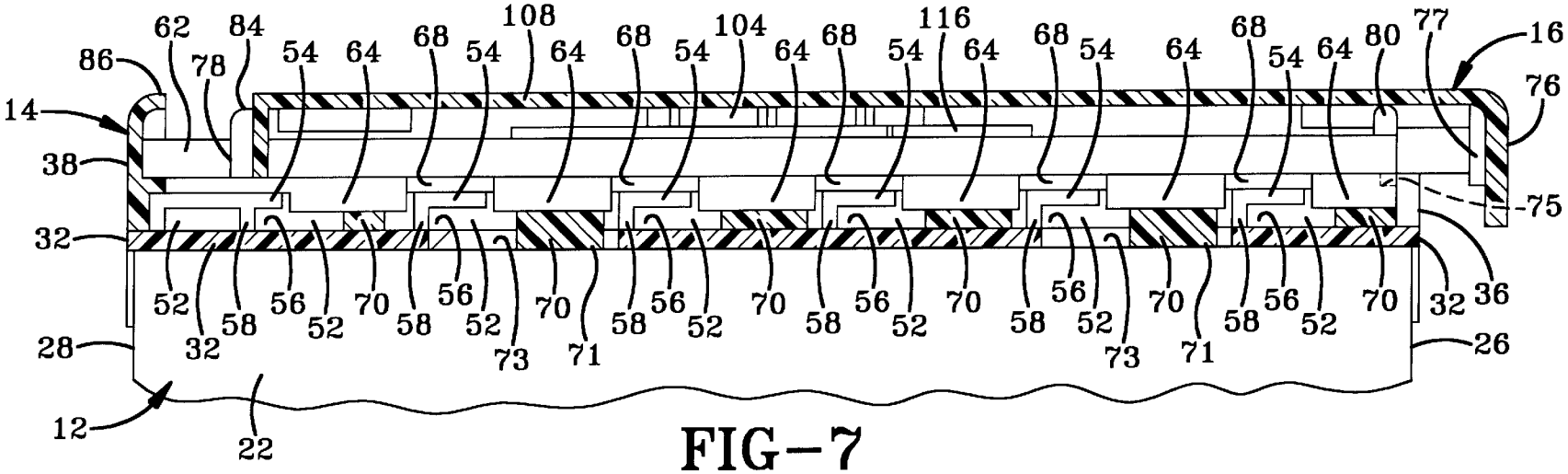
FIG. 7 is a sectional view taken along line 7—7 of FIG. 5.
Figure 8:
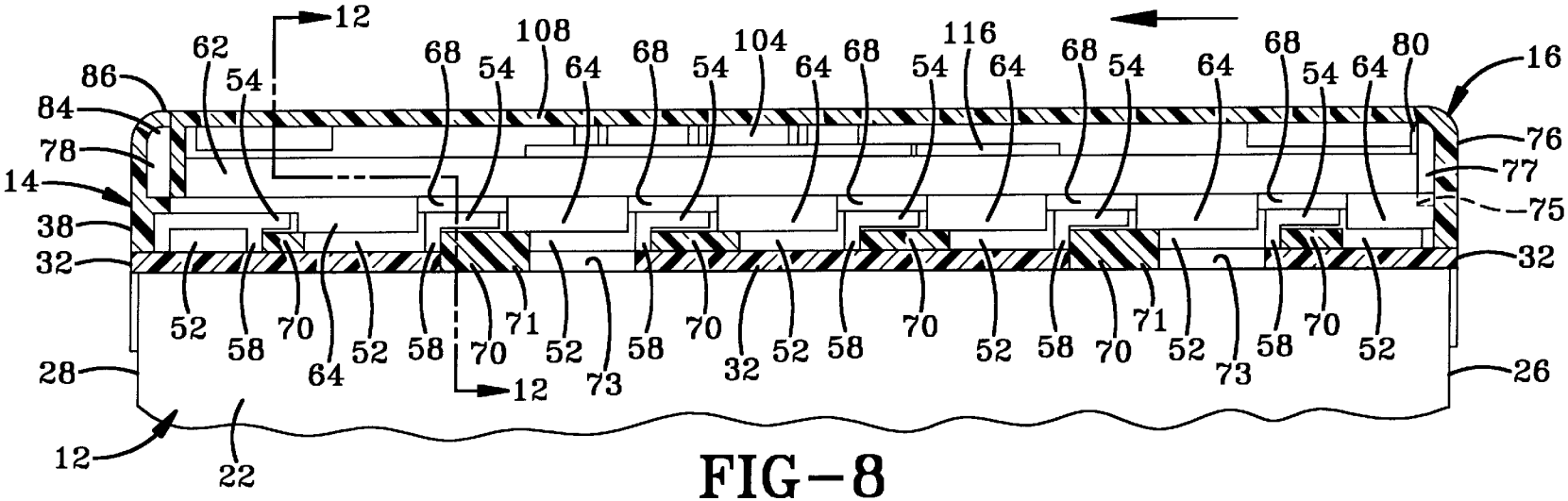
FIG. 8 is a sectional view taken along line 8—8 of FIG. 6.

Tangs 70 are movable with slide latch 16 between the unlocked position depicted in FIG. 7 and the locked position depicted in FIG. 8. Two of tangs 70 are longer than other tangs 70. These two tangs are indicated by the numeral 71 in addition to the numeral 70 to indicate tangs generally. Longer tangs 71 are configured to fit within tang openings 73 that are formed within lip 32. With this configuration, longer tangs 71 slide through opening 73 in lip 32 to prevent front wall 34 of slide latch 16 from being pried open in the forward direction. Tangs 70 slide with slide latch 16 below second ledges 64 and help retain slide latch 16 on lid 14. Lid 14 may be moved to the closed position when tangs are in the unlocked position below second ledges 64. When lid 14 is moved to the closed position, tangs 70 are automatically positioned in locking channels 56 where they may be moved between the unlocked and locked positions. Tangs 70 and slide latch 16 have been moved to the locked position in FIG. 8. In this position, tangs 70 are disposed at least partially below first ledges 54 and may abut end walls 58. In this position, lid 14 cannot be opened because first ledges 54 engage tangs 70 as may be seen in FIG. 11. When tangs 70 and slide latch 16 are in the locked position with lid 14 in the closed position, box 12 cannot be opened without the use of key 18.

Figure 13:
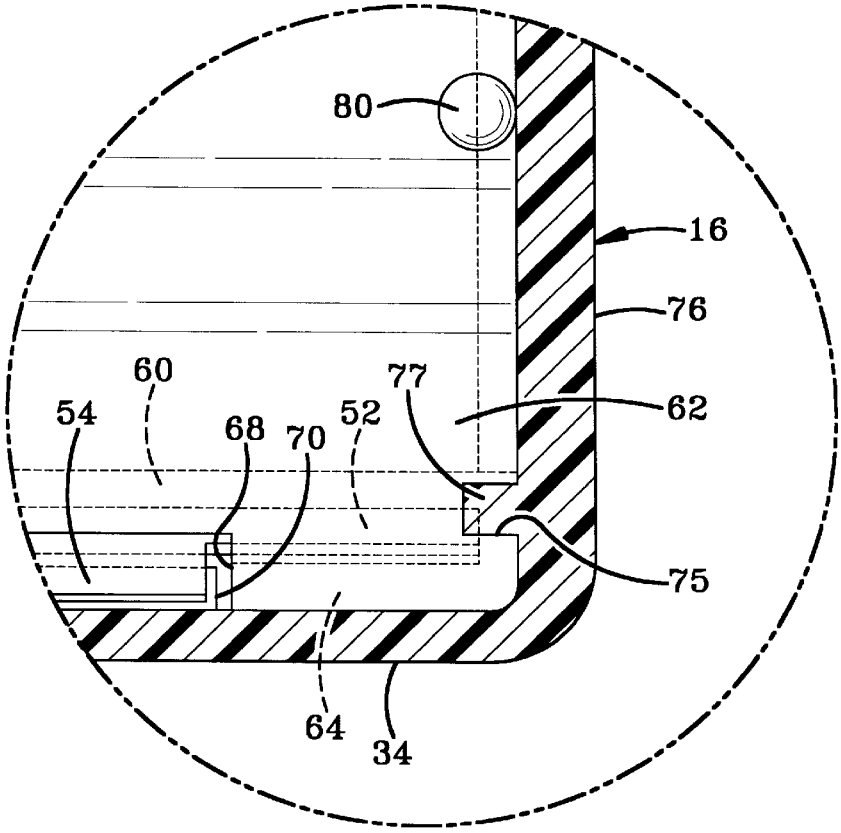
FIG. 13 is an enlarged view of the encircled portion of FIG. 6.

In accordance with another objective of the present invention, slide latch 16 is carried on the outside of lid 14 where it can be directly grasped by the user and moved from the unlocked position to the locked position. A special tool is thus not needed for moving slide latch 16 to the locked position and locking security container 10 thus may be quickly and easily achieved. As described above, slide latch 16 engages lid 14 where tangs 70 slidably engage second ledges 64. Slide latch 16 also engages lid 14 with a pair of hooks 72 that are received in slots 74 formed in rear wall 48 of lid 14. Slots 74 also allow slide latch 16 to be initially assembled. Slide latch 16 further includes a first sidewall 76 and a second sidewall 78. A support post 80 extends up from top wall 62 of lid 14 to further support and position slide latch 16 on lid 14. A strengthening notch 75 is formed in lid 14 adjacent the front right hand corner as depicted in FIG. 3. A strengthening bar 77 is formed on slide latch 16 and is disposed and configured in a location where it is snugly received in notch 75 when slide latch is in the locked position as depicted in FIGS. 8 and 13. The provision of notch 75 and bar 77 strengthen the corner of security container 10.

Figure 9:
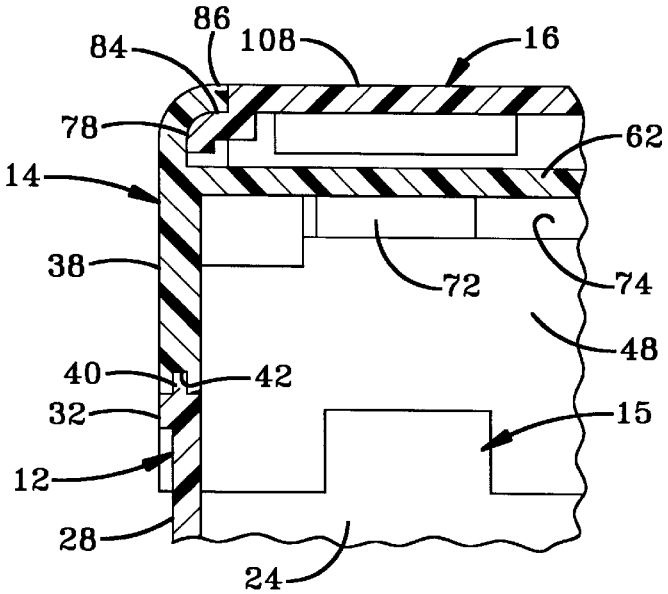
FIG. 9 is a sectional view taken along line 9—9 of FIG. 6.
Figure 10:
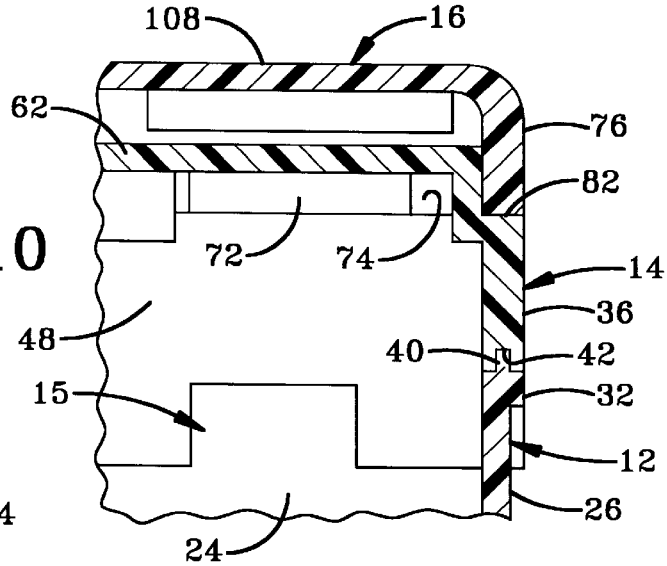
FIG. 10 is a sectional view taken along line 10—10 of FIG. 6.

First sidewall 36 of lid 14 includes a first shoulder 82 that receives first sidewall 76 of slide latch 16 when slide latch 16 is in the locked position as shown in FIG. 10. First shoulder 82 provides a smooth connection between slide latch 16 and lid 14 and prevents the insertion of a pry bar between lid 14 and slide latch 16. A second shoulder 84 is formed on second sidewall 78 of slide latch 16. Second shoulder 84 fits snugly under an overhang 86 that is formed at the top of second sidewall 38 of lid 14. Overhang 86 and second shoulder 84 prevent a pry bar from being inserted between slide latch 16 and lid 14 when slide latch 16 is in the locked position as shown in FIG. 9.

A locking mechanism 100 is carried by security container 10 and includes a plurality of locking fingers 102 carried by lid 14 and a pair of ribbed slides 104 carried by slide latch 16. As shown in FIG. 2, ribbed slides 104 extend through top wall 62 of lid 14 and are disposed between locking fingers 102 when slide latch 16 is connected to lid 14. A keyhole 106 is formed in the top wall 108 of slide latch 16 to correspond with each locking finger 102. In the preferred embodiment of the present invention, six keyholes 106 and six locking fingers 102 are provided. Each ribbed slide 104 includes three ribs 110, 112, and 114. Keyholes 106 are disposed immediately behind each rib 110, 112, and 114. A protective wall 116 encircles locking fingers 102 and further prevents a potential shoplifter from interfering with locking fingers 102 when lid 14 is closed and slide latch 16 is in the locked position.

Key 18 includes a plurality of prongs 118 that are configured to slide through keyholes 106 and engage locking fingers 102 to urge them to an unlocked position where they release ribs 110, 112, and 114.

Figure 5:
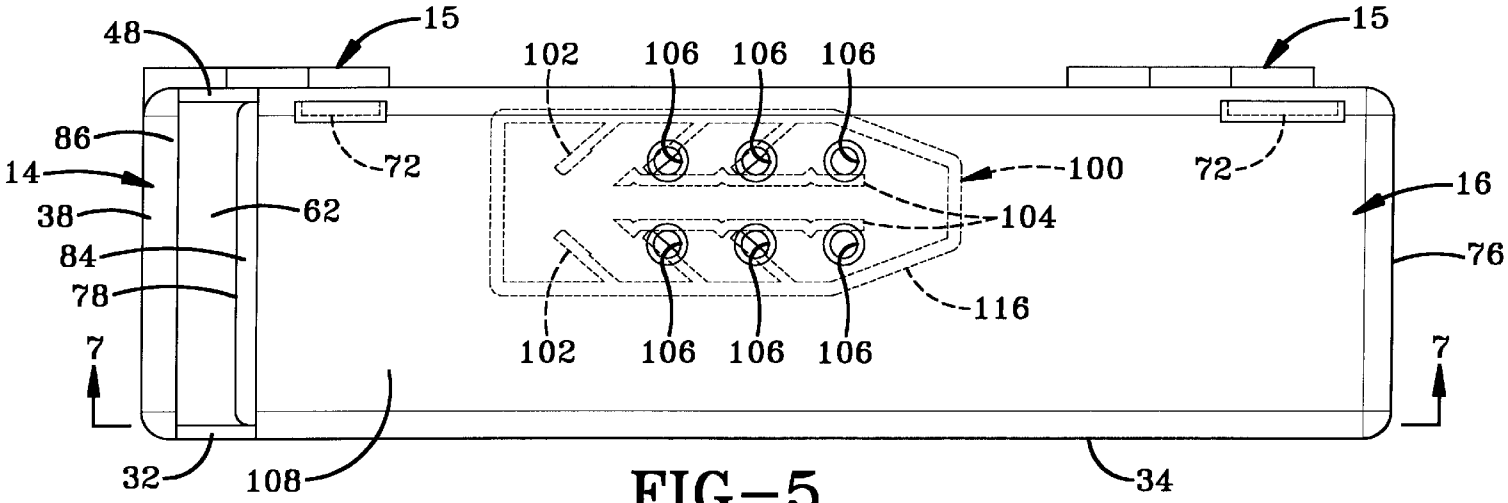
FIG. 5 is a top view of the security container of the present invention with the slide latch in the unlocked position.
Figure 6:
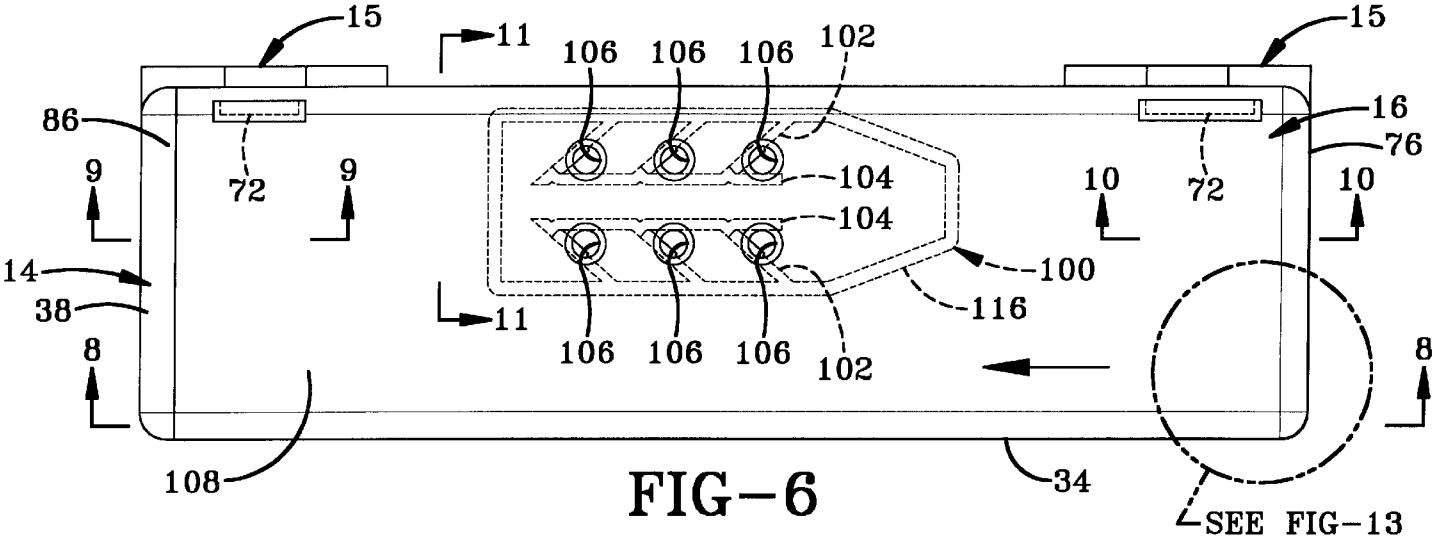
FIG. 6 is a view similar to FIG. 5 with the slide latch in the locked position.

Box 12, lid 14, and slide latch 16 of security container 10 are fabricated separately and then assembled. Lid 14 is attached to box 12 by aligning the elements of hinges 15 and inserting a hinge pin in the known manner. Slide latch 16 is then connected to lid 14 by placing hooks 72 in slots 74 and aligning tangs 70 with cut outs 68. Slide latch 16 is then dropped onto lid 14 and moved in the direction of second sidewall 38 of lid 14 until ribs 110 and 112 snap over locking fingers 102. This position is depicted in FIGS. 2, 5, and 7 and is the unlocked position of slide latch 16.

Security container 10 may be locked by moving lid 14 to the closed position depicted in FIGS. 1 and 5 through 11. Slide latch 16 is then moved toward second sidewall 38 of lid 14 until ribs 110, 112, and 114 all engage locking fingers 102 to lock the position of slide latch 16 with respect to lid 14. When this occurs, tangs 70 are moved under at least a portion of each first ledge 54 to lock lid 14 and slide latch 16 in the closed position with respect to box 12.

Figure 4:
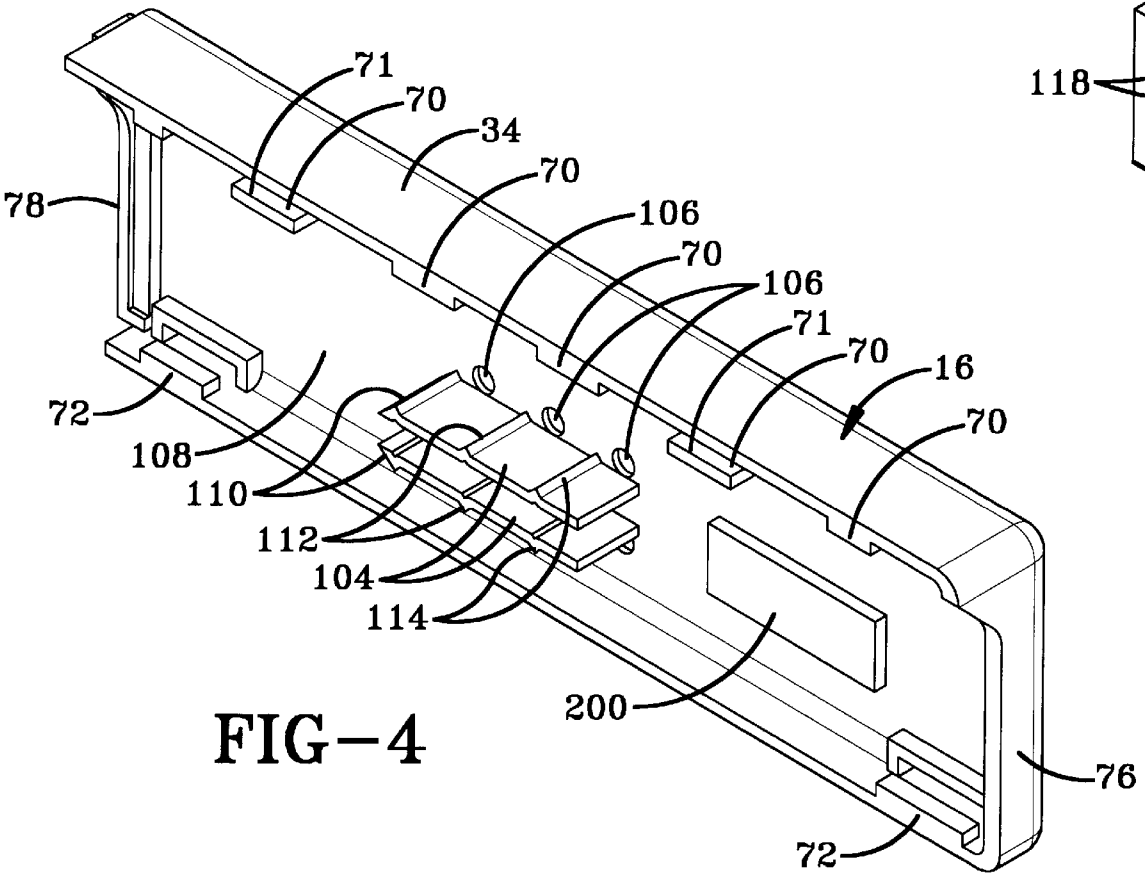
FIG. 4 is a perspective view of the slide latch.

Security container 10 is opened by inserting key 18 into locking mechanism 100 to release the engagement of locking fingers 102 with ribs 110, 112, and 114. When this occurs, slide latch 16 is moved in the direction of first sidewall 36 of lid 14 and tangs 70 are moved out from under first ledges 54 to allow lid 14 to move toward the open position. Slide latch 16 is not removed from lid 14 when lid 14 is open. Slide latch 16 does not fall off of lid 14 when slide latch 16 is in the unlocked position because tangs 70 are held under second ledges 64. The contents of box 12 may then be removed and security container 10 reused with a different product FIG. 4 depicts an EAS tag 200 positioned on lid 16. EAS tag 200 may be positioned in a wide variety of other locations.

Accordingly, the improved storage container is simplified, provides an effective, safe, inexpensive, and efficient device that achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the storage container is constructed and used, the characteristics of the construction, and the advantageous new and useful results obtained; the new and useful structures, devices, elements, arrangements, parts, and combinations are set forth in the appended claims.

What is claimed:

1. A security storage container, comprising:

a box having an open top;

a lid hingedly connected to said box and movable between open and closed positions;

a plurality of first ledges disposed on said box;

a plurality of second ledges disposed on said lid;

said second ledges being adjacent said first ledges when said lid is in said closed position;

a slide latch slidably carried by said lid and movable between locked and unlocked positions, said slide latch holding said lid closed when in said locked position; said slide latch carried on the outside of said lid; said slide latch being retained on said lid when said lid is in the open position;

a plurality of tangs on said slide latch, one of said tangs being disposed under one of said second ledges when said slide latch is in said unlocked position; one of said tangs being at least partially disposed under one of said first ledges when said slide latch is in said locked position;

a lock mechanism that locks said slide latch in said locked position; said lock mechanism only being unlocked with a special key; and a lip on said box, said first ledges disposed above said lip to form a locking channel between each first ledge and said lip.

2. The container of claim 1, further comprising an end wall extending between each of said first ledges and said lip.

3. The container of claim 1, wherein said slide latch has a front surface that mates with said lip to form a smooth connection between said slide latch and said box.

4. A security storage container, comprising:

a box having an open top;

lid hingedly connected to said box and movable between open and closed positions;

a slide latch slidably carried by said lid and movable between locked and unlocked positions, said slide latch holding said lid closed when in said locked position; said slide latch carried on the outside of said lid; and a lock mechanism that locks said slide latch in said locked position;

a plurality of first ledges disposed on said box;

a plurality of second ledges disposed on said lid;

said second ledges being adjacent said first ledges when said lid is in said closed position;

a plurality of tangs on said slide latch, one of said tangs being disposed under one of said second ledges when said slide latch is in said unlocked position; one of said tangs being at least partially disposed under one of said first ledges when said slide latch is in said locked position;

a lip on said box, said first ledges disposed above said lip to form a locking channel between each first ledge and said lip;

said slide latch having a front surface that mates with said lip to form a smooth connection between said slide latch and said box; and a stopping wall extending upward from said lip, said second ledges fitting over said stopping wall when said lid is in said closed position.

5. The container of claim 3, wherein said lip extending about the sides of said box, said lid having side walls that mate with said lip to form a smooth connection between said lid and said box.

6. A security storage container, comprising:

a box having an open top;

a lid hingedly connected to said box and movable between open and closed positions;

a slide latch slidably carried by said lid and movable between locked and unlocked positions, said slide latch holding said lid closed when in said locked position; said slide latch carried on the outside of said lid;

a lock mechanism that locks said slide latch in said locked position;

a plurality of first ledges disposed on said box;

a plurality of second ledges disposed on said lid;

said second ledges being adjacent said first ledges when said lid is in said closed position;

a plurality of tangs on said slide latch, one of said tangs being disposed under one of said second ledges when said slide latch is in said unlocked position; one of said tangs being at least partially disposed under one of said first ledges when said slide latch is in said locked position a lip on said box, said first ledges disposed above said lip to form a locking channel between each first ledge and said lip said slide latch has a front surface that mates with said lip to form a smooth connection between said slide latch and said box said lip extending about the sides of said box, said lid having side walls that mate with said lip to form a smooth connection between said lid and said box; and a pair of tenons extending up from said lip and a pair of mortises formed in said side walls of said lid, said tenons being received in said mortises when said lid is in said closed position.

7. A security storage container, comprising:

a box having an open top;

a lid hingedly connected to said box and movable between open and closed positions;

a slide latch slidably carried by said lid and movable between locked and unlocked positions, said slide latch holding said lid closed when in said locked position; said slide latch carried on the outside of said lid;

a lock mechanism that locks said slide latch in said locked position;

a plurality of first ledges disposed on said box;

a plurality of second ledges disposed on said lid;

said second ledges being adjacent said first ledges when said lid is in said closed position;

a plurality of tangs on said slide latch, one of said tangs being disposed under one of said second ledges when said slide latch is in said unlocked position; one of said tangs being at least partially disposed under one of said first ledges when said slide latch is in said locked position;

a lip on said box, said first ledges disposed above said lip to form a locking channel between each first ledge and said lip;

said slide latch has a front surface that mates with said lip to form a smooth connection between said slide latch and said box;

said lip extending about the sides of said box, said lid having side walls that mate with said lip to form a smooth connection between said lid and said box; and a pair of hinges connecting said lid to said box; a shoulder formed on said box between said hinges and a channel formed on said lid; said shoulder being received in said channel when said lid is in said closed position.

8. A security storage container, comprising:

a box having an open top;

a lid hingedly connected to said box and movable between open and closed positions;

a slide latch slidably carried by said lid and movable between locked and unlocked positions, said slide latch holding said lid closed when in said locked position; said slide latch carried on the outside of said lid;

a lock mechanism that locks said slide latch in said locked position;

a plurality of first ledges disposed on said box;

a plurality of second ledges disposed on said lid;

said second ledges being adjacent said first ledges when said lid is in said closed position;

a plurality of tangs on said slide latch, one of said tangs being disposed under one of said second ledges when said slide latch is in said unlocked position; one of said tangs being at least partially disposed under one of said first ledges when said slide latch is in said locked position;

a lip on said box, said first ledges disposed above said lip to form a locking channel between each first ledge and said lip; and at least one of said tangs passes through an opening in said lip when said lid is in said closed position.

9. A security storage container, comprising:

a box having an open top;

a lid hingedly connected to said box and movable between open and closed positions;

a slide latch slidably carried by said lid and movable between locked and unlocked positions, said slide latch holding said lid closed when in said locked position; said slide latch carried on the outside of said lid;

a lock mechanism that locks said slide latch in said locked position; and said lid having a first side wall and a second side wall; said lid having a shoulder on said first side wall, said slide latch having a first sidewall that sits on said shoulder when said slide latch is in said locked position to form a smooth connection between said first side wall of said slide latch and said first side wall of said lid.

10. The container of claim 9, further comprising an overhanging wall extending from said second side wall of said lid, said slide latch having a shoulder at a second side wall of said slide latch that fits under said overhanging wall when said slide latch is in said locked position.

11. A security storage container, comprising:

a box having an open top;

a lid hingedly connected to said box and movable between open and closed positions;

a slide latch slidably carried by said lid and movable between locked and unlocked positions, said slide latch holding said lid closed when in said locked position; said slide carried on the outside of said lid;

a lock mechanism selectively locks said slide latch in said locked position;

at least two tangs extend from said slide latch;

a lip on said box, said lip having an opening aligned with each tang; and each tang passing through an opening in said lip when said lid is in said closed position.

12. The security device of claim 11, further comprising:

a plurality of first ledges disposed on said box;

a plurality of second ledges disposed on said lid;

said second ledges being adjacent said first ledges when said lid is in said closed position; and one of said tangs being disposed under one of said second ledges when said slide latch is in said unlocked position; one of said tangs being at least partially disposed under one of said first ledges when said slide latch is in said locked position.

* * * * *